US005168139A

United States Patent [19]

Bettge et al.

[11] Patent Number: 5,168,139

[45] Date of Patent: Dec. 1, 1992

[54] LOAD-BREAK SWITCH HAVING A VACUUM INTERRUPTER AND METHOD OF OPERATION

[75] Inventors: Hans Bettge; Peter Krüger; Michael Röse, all of Berlin, Fed. Rep. of Germany

[73] Assignee: Siemens Aktiengesellschaft, Berlin & Munich, Fed. Rep. of Germany

[21] Appl. No.: 671,919

[22] PCT Filed: Oct. 28, 1988

[86] PCT No.: PCT/DE88/00674

§ 371 Date: Mar. 22, 1991

§ 102(e) Date: Mar. 22, 1991

[87] PCT Pub. No.: WO90/03657

PCT Pub. Date: Apr. 5, 1990

[30] Foreign Application Priority Data

Sep. 22, 1988 [DE] Fed. Rep. of Germany ..... 3832493

[51] Int. Cl.[5] ..... H01H 33/66

[52] U.S. Cl. ..... 200/144 B

[58] Field of Search ..... 200/144 B, 146 R, 144 AP, 200/145

[56] References Cited

U.S. PATENT DOCUMENTS

| | | | |
|---|---|---|---|
| 3,548,135 | 12/1970 | Wood | 200/144 B |
| 3,646,294 | 2/1972 | McCloud | 200/144 B |
| 3,769,538 | 10/1973 | Harris | 200/144 B X |
| 3,824,359 | 7/1974 | Date | 200/146 R |
| 3,825,789 | 7/1974 | Harris | 200/144 B |
| 4,434,332 | 2/1984 | Yanabu et al. | 200/144 AP |
| 4,438,307 | 3/1984 | Lippmann et al. | 200/144 B |
| 4,814,559 | 3/1989 | Stegmüller | 200/145 |

FOREIGN PATENT DOCUMENTS

| | | |
|---|---|---|
| 714486 | 9/1968 | Belgium . |
| 2308913 | 10/1973 | Fed. Rep. of Germany . |
| 2522525 | 12/1976 | Fed. Rep. of Germany . |
| 2638700 | 3/1978 | Fed. Rep. of Germany . |
| 3131271 | 8/1982 | Fed. Rep. of Germany . |
| 1309197 | 3/1973 | United Kingdom . |
| 1480285 | 7/1977 | United Kingdom . |

*Primary Examiner*—J. R. Scott

*Attorney, Agent, or Firm*—Kenyon & Kenyon

[57] ABSTRACT

A load-break switch includes a vacuum interrupter and two blade-type switches. The vacuum interrupter comprises an insulating, tubular housing with two conductive end caps and two coaxially opposing contact studs. The contact surfaces of the contact studs are configured inside the housing. One of the blade-type switches is configured parallel to the vacuum interrupter and the other switch is arranged in series with this parallel connection. The contact studs are formed from a chromium-nickel steel. The end faces of these contact studs form the contact surfaces of the vacuum interrupter.

2 Claims, 1 Drawing Sheet

LOAD-BREAK SWITCH HAVING A VACUUM INTERRUPTER AND METHOD OF OPERATION

BACKGROUND OF THE INVENTION

The present invention relates to electrical switching devices, and more particularly, relates to the development and operation of a load-break switch which includes a vacuum interrupter.

Generally, vacuum interrupters used for electrical switching devices, particularly in the 6 to 35 kV voltage range, include an insulating, tubular housing having two conductive end caps. Two coaxially opposing contact studs are introduced into the housing through the conductive end caps. One contact stud is directly connected in a vacuum-tight manner to one end cap and the other contact stud is connected via a bellows to the other end cap. The contact studs are provided with contact surfaces configured inside the housing. U.S. Pat. No. 3,590,197 discloses an example of such a configuration. The contact surfaces are formed from contact pieces made of a special material and with a special constructive design. Such a design is disclosed in German Published Patent Application 26 38 700. Contact pieces of iron-containing material such as Maraging steel or rust-free chromium-nickel steels have proven to be suitable as disclosed German Published Patent Application 23 08 913 and British Patent 1 480 285. It is known that the end faces of the contact studs themselves form the contact surfaces in a vacuum interrupter having contact studs of a copper alloy comprising 0.003% to 0.5% boron and preferably 0.1% to 1.00% bismuth as disclosed in British Printed Patent 1 309 197.

Vacuum interrupters can be used for circuit-breakers, and for load-break switches and contactors. In load-break switches, the vacuum interrupters can only be loaded with the maximum allowable continuous-load current. Therefore, in this type of application, the qualities of these interrupters cannot be fully utilized. To better utilize the breaking capacity of the interrupters used in load-break switches, a first switch is configured in series with the vacuum interrupter and a second switch is configured parallel to this series connection. The parallel configured switch is designed for the full load-break-switch rated current. When the load-break switch is disconnected, this parallel configured switch is first opened. Then, the vacuum interrupter executes an arc-breaking. Finally, the series-connected switch opens forming a visible separation point. When the load-break switch is switched on, the vacuum interrupter is connected after the series-configured switch is switched on, or only after both switches are switched on. German Published Paten Application 25 22 525 discloses such a vacuum interrupter switch configuration.

There is a need for a load-break switch which includes a vacuum interrupter that is essentially tailored only to the breaking operation for a load current.

SUMMARY OF THE INVENTION

This and other needs are satisfied by the load-break switch of the present invention. The load-break switch includes a vacuum interrupter and two blade-type switches. The vacuum interrupter comprises an insulating, tubular housing with two conductive end caps and two coaxially opposing contact studs. The contact studs have contact surfaces configured inside the housing.

One contact stud is directly connected in a vacuum-tight manner to the one end cap and the other contact stud is connected via a bellows to the other end cap.

One blade-type switch is configured parallel to the vacuum interrupter. The other blade-type switch is arranged in series to the parallel connection, which includes the vacuum interrupter and a first switch. The contact studs are formed from chromium-nickel steel. The end faces of these contact studs form the contact surfaces of the vacuum interrupter.

The vacuum interrupter of this load-break switch has a very simple construction, especially in the contact point area, since neither specially designed contact pieces nor high-grade contact materials are used. The end faces of the contact studs themselves form the contact surfaces. The contact studs are formed from a commercial steel alloy which is a very inexpensive material.

The configuration of the two blade-type switches and the vacuum interrupter makes possible an improved operation, given an appropriate switching sequence of the three switches. With an appropriate switching sequence, the vacuum interrupter does not conduct any rated current, is not switched into the short-circuit current, and is not required to exhibit any static dielectric strength. Accordingly, when the load-break switch is switched on and the two switches are in the normal closed position, the vacuum interrupter is kept open during the operation of the load-break switch. In order to switch off the load-break switch, the contacts of the vacuum interrupter are first closed, then the parallel-configured switch is opened, then the contact of the vacuum interrupter is opened, and finally the series-arranged switch is opened.

DETAILED DESCRIPTION

Figure 1:
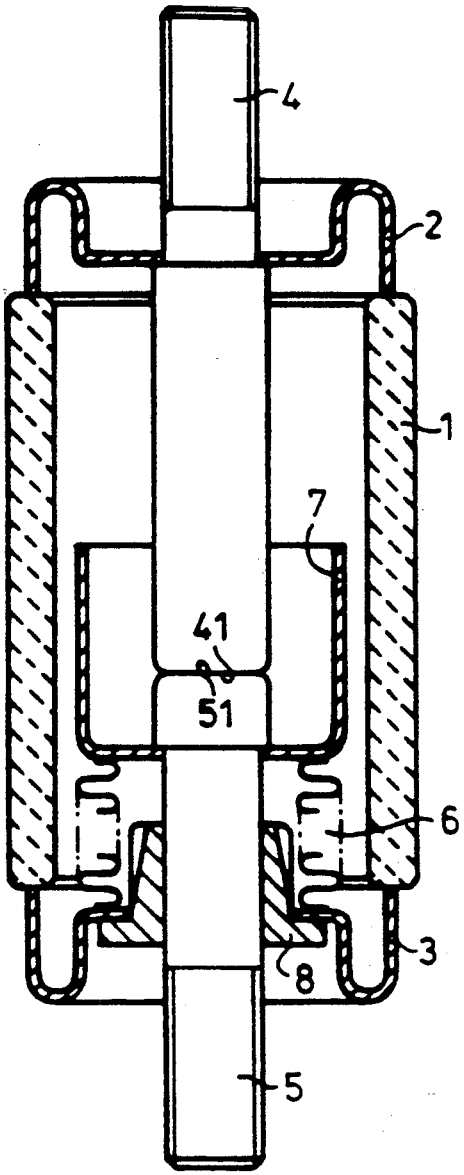
FIG. 1 is an exemplified embodiment of the vacuum interrupter used for the load-break switch, constructed according to the present invention.

Referring to FIG. 1, a vacuum interrupter is shown. The vacuum interrupter comprises a housing 1, which is in the form of a cylindrical insulator of an aluminum-oxide ceramic having two end caps 2 and 3 formed from an oxygen-free copper, and two coaxially opposing cylindrical contact studs 4 and 5. The two end caps 2 and 3 are directly connected to the front ends of the housing 1 as a butt joint in a vacuum-tight manner by a soldered connection. The first end cap 2 is directly connected to the contact stud 4. The second end cap 3 is indirectly soldered to the axially movable contact stud 5 in a vacuum-tight manner via a bellows 6 and a vapor shield 7. Furthermore, the movable contact stud 5 is guided by a flange part 8, which is braced against the end cap 3.

The contact system of the vacuum interrupter comprises the two coaxially opposing, cylindrical contact studs 4 and 5. These contact studs 4 and 5 contact each other in a closed state at end faces 41 and 51, which are turned toward each other. The contact studs 4 and 5 function as contact pieces and as the current supply of the contact system. Other than the slight rounding off of the edges of the contact studs 4 and 5, the contact surfaces are not provided with any constructive measures which influence the electric arc occurring during the switching operation. The contact studs are made of chromium-nickel steel, which is a poor conductor per se. In a vacuum, chromium-nickel steel also has poor welding qualities and shows a low gas content.

Figure 2:
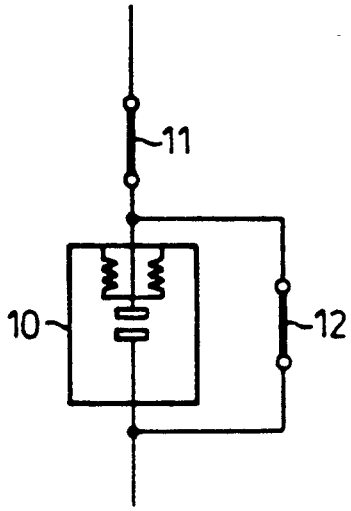
FIG. 2 is a circuit diagram for the assignment of the vacuum interrupter of FIG. 1 to two blade-type switches of a load-break switch.

The vacuum interrupter of FIG. 1 is intended to be used as a load-switching tube. Referring to FIG. 2, a load-break switch is shown. The load-break switch is configured parallel to a blade-type switch 12. A further blade-type switch 11 is arranged in series to this parallel connection. The actuation of such a load-break switch should be set up so that in the normal operating state of the switching device, the vacuum interrupter 10 is switched to an open state. In order to switch off the load-break switch, the vacuum interrupter 10 is first switched on in parallel to the switch 12, then the switch 12 is opened, then the vacuum interrupter 10 is switched off, and finally the switch 11 is likewise opened.

The load-break switch of the present invention is switched on solely by closing the switches 11 and 12. Such an operating method has the advantage that the load-switching tube is neither loaded with the starting short-circuit current nor with the rated current and also is not subjected to any constant static voltage stress. Therefore, only negligible dielectric, dynamic and thermal demands are placed on the vacuum interrupter. This makes it possible to manufacture a vacuum interrupter which is considerably smaller and more cost-effective than previously standard switching tubes.

We claim:

1. A load-break switch, comprising:

a vacuum interrupter comprising:

an insulating tubular housing having two openings;

first and second end caps formed from a conductive material, said end caps coupled to the openings of said housing;

first and second contact studs formed from chromium-nickel steel, said first and second contact studs coaxially and oppositely coupled to each other, said first contact stud coupled to said second contact stud in a vacuum-tight manner, said first and second contact studs having end faces, said end faces forming contact surfaces for said vacuum interrupter; and a bellows coupled between said second contact stud and said second end cap;

a first blade-type switch coupled in parallel to said vacuum interrupter and forming a parallel connection therewith; and a second blade-type switch coupled in series with said parallel connection.

2. A method for operating a load-break switch comprising a vacuum interrupter coupled in parallel to a fist switch to thereby form a parallel connection and a second switch coupled in series with said parallel connection, comprising:

sustaining said vacuum interrupter in an open, non-conducting condition when said load-break switch is switched on and said first and second switching contacts are switched to closed, conducting conditions;

performing the following substeps in sequence when switching off said load-break switch:

a) switching said vacuum interrupter to a closed condition;

b) switching said first switch to an open condition;

c) switching said vacuum interrupter to an open condition; and d) switching said second switch to an open condition.

* * * * *